US006619210B1

(12) United States Patent
Spivak et al.

(10) Patent No.: US 6,619,210 B1
(45) Date of Patent: Sep. 16, 2003

(54) EXPLOSIVELY FORMED PENETRATOR (EFP) AND FRAGMENTING WARHEAD

(75) Inventors: Timothy L. Spivak, King George, VA (US); Maurice E. Grudza, Langhorne, PA (US); William J. Clark, Mullica Hill, NJ (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/104,332

(22) Filed: Mar. 25, 2002

(51) Int. Cl.[7] ..... F42B 12/10; F42B 12/24; F42B 12/32

(52) U.S. Cl. ..... 102/476; 102/475; 102/492; 102/493; 102/495

(58) Field of Search ..... 102/305–310, 102/475, 476, 491–497, 501

(56) References Cited

U.S. PATENT DOCUMENTS

| | | | | | |
|---|---|---|---|---|---|
| 2,763,210 | A | * | 9/1956 | Church et al. | 102/307 |
| 3,960,085 | A | * | 6/1976 | Abernathy et al. | 102/494 |
| 3,980,019 | A | * | 9/1976 | Anderson et al. | 102/489 |
| 4,157,068 | A | * | 6/1979 | Rognmo | 102/489 |
| 4,222,329 | A | * | 9/1980 | Austin | 102/307 |
| 4,648,323 | A | * | 3/1987 | Lawther | 102/495 |
| 4,711,181 | A | * | 12/1987 | Ringel et al. | 102/476 |
| H699 | H | * | 11/1989 | Thomas, Sr. | 102/489 |
| 4,920,887 | A | * | 5/1990 | Frehaut et al. | 102/489 |
| 4,974,516 | A | * | 12/1990 | Eyal et al. | 102/476 |
| 5,038,683 | A | * | 8/1991 | Baker et al. | 102/308 |
| 5,070,786 | A | * | 12/1991 | Hartman et al. | 102/476 |
| 5,313,890 | A | * | 5/1994 | Cuadros | 102/496 |
| 5,509,357 | A | * | 4/1996 | Lawther | 102/476 |
| 5,559,304 | A | * | 9/1996 | Schweiger et al. | 102/476 |

FOREIGN PATENT DOCUMENTS

| | | | | |
|---|---|---|---|---|
| DE | 2205074 | * | 3/1977 | 102/476 |

* cited by examiner

*Primary Examiner*—Harold J. Tudor
(74) *Attorney, Agent, or Firm*—Matthew J. Bussan, Esq.; James B. Bechtel, Esq.; Peter J. Van Bergen, Esq.

(57) ABSTRACT

A warhead casing defines a geometry that is a portion of a ring having an outer radial wall and an inner radial wall spaced radially apart from one another. The outer radial wall and inner radial wall are joined radially by side walls, while the casing is enclosed at either axial end thereof by end walls. An explosive material fills the casing. At least one initiator is positioned in the explosive material along a radial plane that bisects the portion of the ring. Detonation of the explosive material causes the inner radial wall to form an EFP while the outer radial wall fragments.

33 Claims, 4 Drawing Sheets

FIG.3
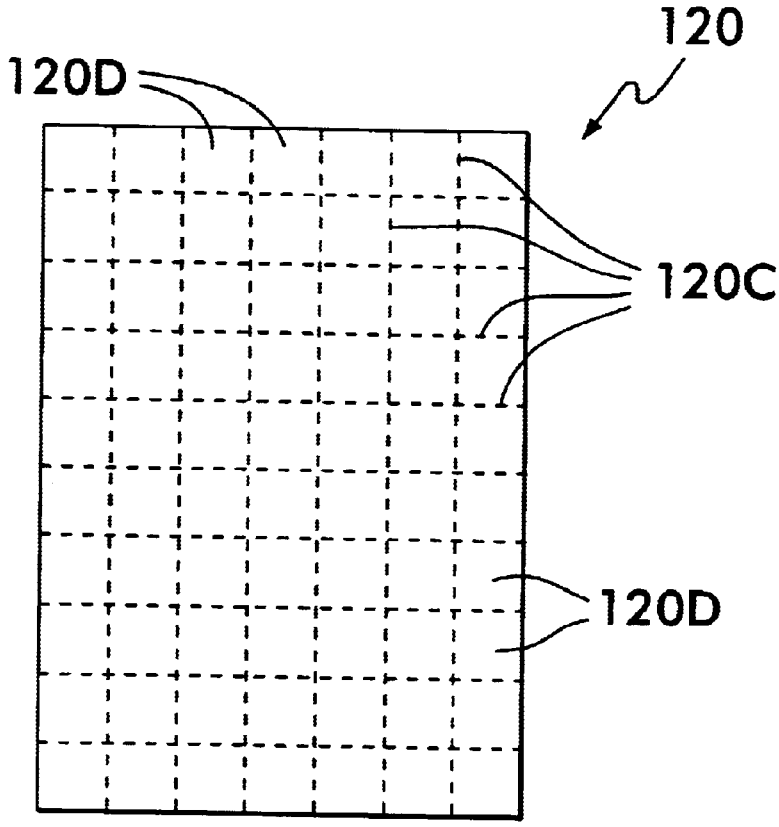
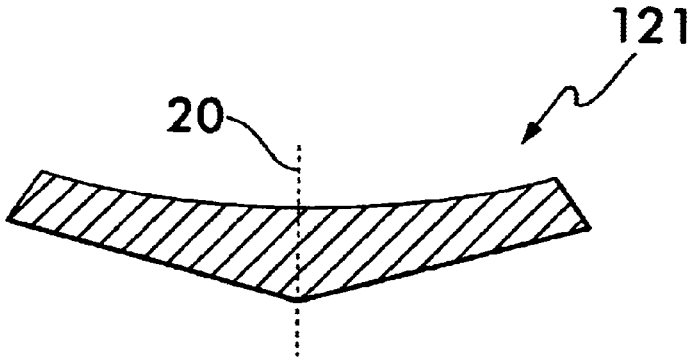
FIG.4

FIG.5
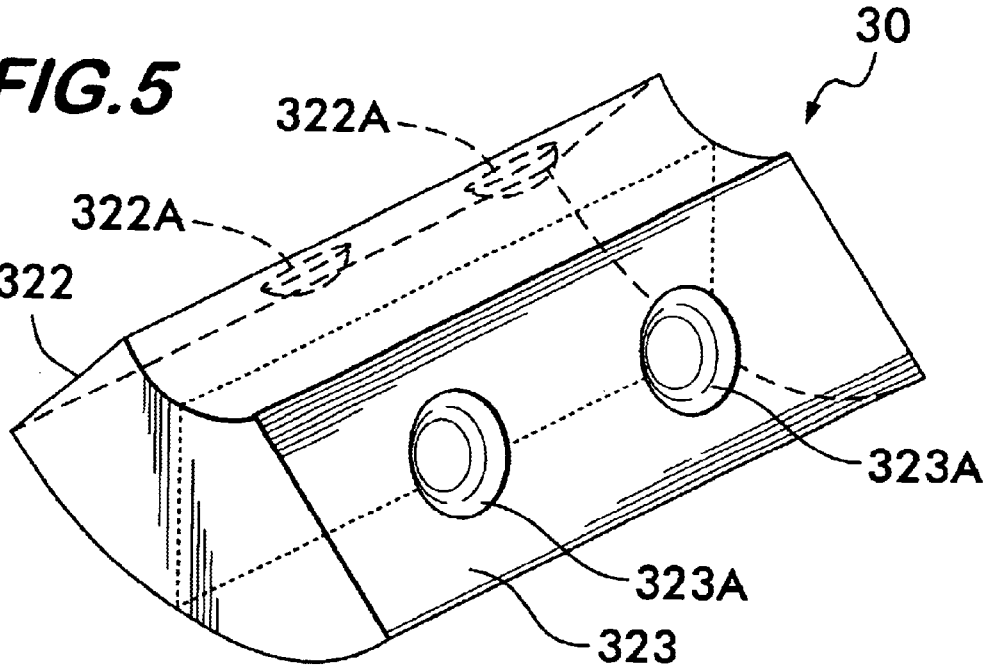
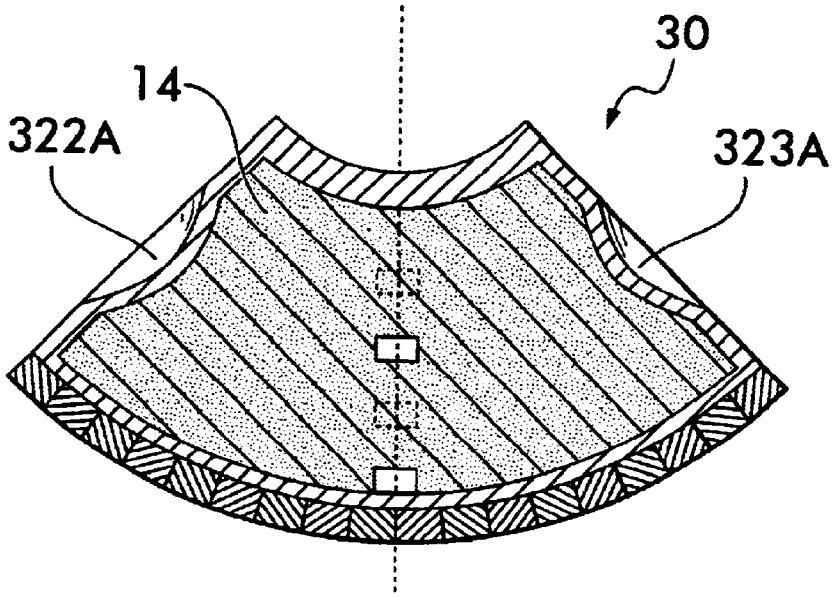
FIG.6

EXPLOSIVELY FORMED PENETRATOR (EFP) AND FRAGMENTING WARHEAD

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to warhead design, and more particularly to a warhead that can produce both an explosively formed penetrator (EFP) and fragments upon detonation.

BACKGROUND OF THE INVENTION

During the past twenty years or so, advances in military technology have focused on target recognition, guidance and control, propulsion systems and airframe technology, while the area of warhead technology has been largely ignored. However, the quantity, hardness and complexity of the various threats that warheads encounter have advanced considerably. Thus, any given mission could require the use of fragmenting warheads, explosively formed penetrating (EFP) warheads, a combination of these two types of warheads, or even a large warhead capable of defeating a large target. To address all of these scenarios for any given mission currently requires the use of specifically-designed, single-function warheads which may require the use of a different delivery platform for each type of warhead. The increased cost and logistics associated with applying current warhead technology begs for its improvement.

SUMMARY OF THE INVENTION

Accordingly, it is an object of the present invention to provide a warhead design that can expel fragments and an explosively formed penetrator (EFP).

Another object of the present invention is to provide a warhead constructed to be adaptable in its response.

Still another object of the present invention is to provide an adaptable warhead capable of expelling fragments and at least one EFP upon detonation.

Yet another object of the present invention is to provide an adaptable warhead that is easily incorporated into a larger, unitary structure.

Other objects and advantages of the present invention will become more obvious hereinafter in the specification and drawings.

In accordance with the present invention, a warhead is provided that forms both an explosively formed penetrator (EFP) and fragments. The warhead's casing defines a geometry that is a portion of a ring having an outer radial wall and an inner radial wall spaced radially apart from one another. The outer radial wall and inner radial wall are joined radially by side walls, while the casing is enclosed at either axial end thereof by end walls. An explosive material fills the casing. At least one initiator is positioned in the explosive material along a radial plane that bisects the portion of the ring. Detonation of at least one initiator detonates the explosive material. The inner radial wall is constructed to form an EFP after detonation of the explosive material. The outer radial wall is constructed to form fragments after detonation of the explosive material.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein:

FIG. 3 is an isolated plan view of another construction for the warhead's outer radial fragment-forming wall;

FIG. 4 is an isolated, axial cross-sectional view of another construction for the warhead's inner radial EFP-forming wall;

FIG. 5 is a perspective view of another embodiment of the warhead of the present invention in which multiple EFPs are formed after detonation thereof;

FIG. 6 is an axial cross-sectional view of the warhead in FIG. 5;

DETAILED DESCRIPTION OF THE INVENTION

Figure 1:
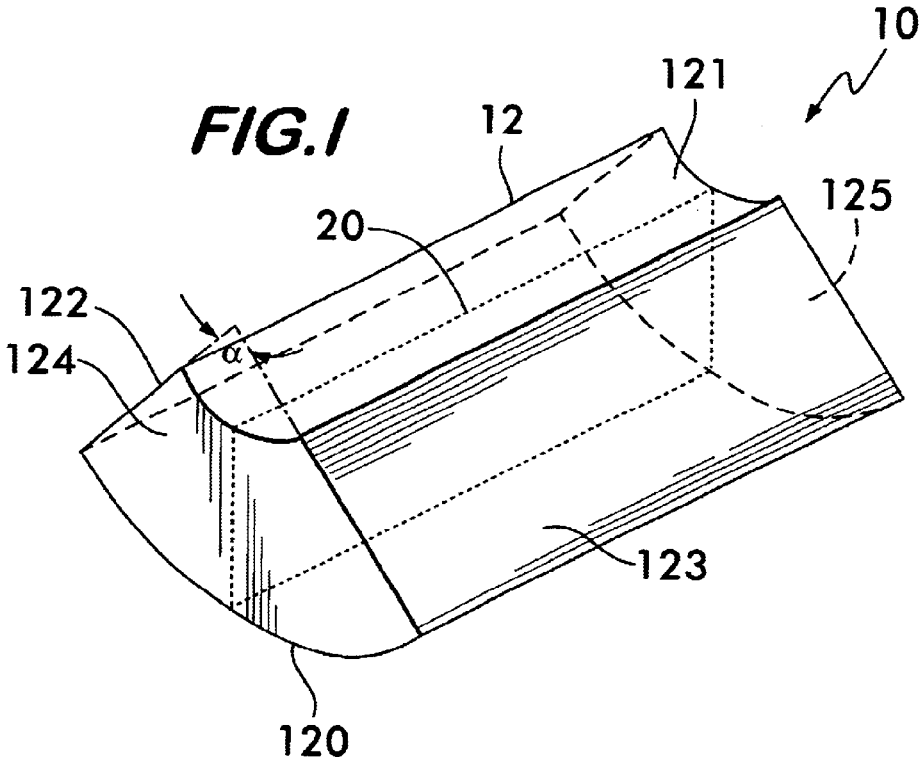
FIG. 1 is a perspective view of a combination explosively formed penetrator (EFP) and fragmenting warhead in accordance with an embodiment of the present invention.

Referring now to the drawings, simultaneous reference will be made to FIGS. 1 and 2 where one embodiment of a combination explosively formed penetrator (EFP) and fragmenting warhead in accordance with the present invention is shown and referenced generally by numeral 10. As will be explained further below, warhead 10 is a submunition that will be separated from a delivery vehicle (e.g., projectile, missile, etc.) over a target area and then detonated to generate at least one EFP and fragments. The orientation of warhead 10 at detonation will determine the flight direction of the EFP(s) and fragments.

In the illustrated embodiment, warhead 10 has a sealed casing 12 with a wedge-based cross section. Casing 12 is filled with explosive material 14, the choice of which is not a limitation of the present invention. Positioned in explosive material 14 are one or more initiators 16. Positioning of initiators 16 will be discussed further below.

Casing 12 is defined by an outer radial wall 120, an inner radial wall 121, sidewalls 122 and 123 that separate and join radial walls 120 and 121, and end walls 124 and 125 that define the axial ends of casing 12. Thus, casing 12 essentially defines a geometry that is a portion of a ring that subtends an angle a that is typically 90° or less, but can be greater. In the illustrated embodiment, casing 12 is a portion of a cylindrical ring. However, other geometrical ring shapes can be used without departing from the scope of the present invention.

Casing 12 can be made from a variety of materials (e.g., metal, composites, plastics or other similar materials) and can be constructed in parts that are welded or bonded together, or can be constructed as a unitary or molded part.

Regardless of construction, outer radial wall 120 is designed to form fragments after detonation of explosive material 14. For example, as illustrated in FIG. 2, outer radial wall 120 can have a thin inner solid wall 120A joined to side walls 122 and 123 and in contact with explosive material 14. Wall 120A functions as a gas check designed to withstand a small amount of detonation pressure before vaporizing as would be understood by one of ordinary skill in the art. Attached to the exterior surface of wall 120A are a plurality of objects 120B that will be expelled as fragments after wall 120A vaporizes and detonation pressure acts on objects 120B. Each of objects 120B is typically a solid object made of a hard material such as metal. The shape of objects 120B can be tailored for a specific application and is not a limitation of the present invention.

Outer radial wall 120 could also be constructed as a one-piece wall scored with a predetermined fragmentation pattern. For example, FIG. 3 illustrates such a wall 120 where dashed lines 120C represent score lines in wall 120. Score lines 120C define fracture lines for wall 120 after detonation of the warhead so that fragments 120D are formed. As before, the shape of the fragments formed is not a limitation of the present invention. Accordingly, the score lines can define any regular fragmentation pattern (e.g., squares, triangles, hexagons, etc.), can define any irregular or random fragmentation pattern, or can define a combination of regular and irregular patterns.

Inner radial wall 121 forms an EFP after detonation of explosive material 14 when initiator(s) 16 lie on a radial plane (indicated by dashed lines 20) that bisects casing 12. That is, radial plane 20 bisects the angle $\alpha$ subtended by casing 12. While tests of the present invention have shown that warhead 10 will produce both an EFP and fragments when initiator(s) 16 are placed anywhere on radial plane 20, performance of the generated EFP is optimized when a single initiator 16 is used and positioned immediately adjacent outer radial wall 120 and centered axially between end walls 124 and 125. However, by providing additional initiators 16 along radial plane 20 as shown (i.e., the solid lined ones of initiators 16 lie axially between end walls 124 and 125, and the dashed lined ones of initiators 16 lying elsewhere on radial plane 20), the present invention can be adapted/optimized for other scenarios such as fragmentation pattern, direction, etc. If multiple initiators 16 are provided, detonation of one or more thereof can be carried out in accordance with a predetermined/preprogrammed plan. Alternatively, warhead 10 could be equipped with a receiver/controller (not shown) coupled to each of initiators 16. In this way, in-flight detonation of selective ones of initiations 16 could be controlled from a remote location thereby allowing the performance of warhead 10 to be optimized for a changing mission scenario.

Figure 2:
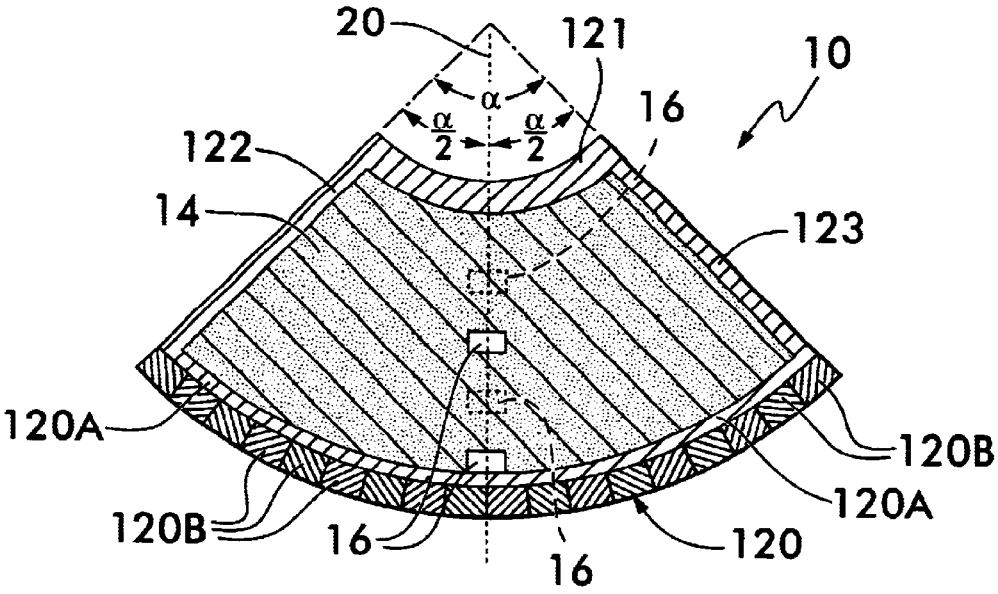
FIG. 2 is an axial cross-sectional view of the warhead in FIG. 1 taken at the axial midpoint thereof.

Inner radial wall 121 can have a constant thickness as illustrated in FIG. 2. However, it is to be understood that the geometry of inner radial wall 121 is not so limited. For example, inner radial wall 121 can be formed as illustrated in FIG. 4 where the wall's thickness is greatest along radial plane 20, but then decreases (e.g., linearly, geometrically or in accordance with a complex function) on either side of radial plane 20 as a function of the distance therefrom. Tests of this construction have indicated that such thickness tapering of inner radial wall 121 reduces the velocity gradient experienced by wall 121 after detonation of explosive material 14. The reduced velocity gradient helps to prevent fracturing of wall 121 (after detonation) to ensure the formation of a one-piece EFP.

As mentioned above, the present invention can be constructed to generate multiple EFPs and fragments after the detonation thereof. A warhead for accomplishing this is illustrated in perspective and cross-sectional views in FIGS. 5 and 6, respectively, and is referenced generally by numeral 30. Warhead 30 is similar in construction to warhead 10 with the parts that are identical not being discussed further herein. The difference between the two embodiments is that side walls 322 and 323 of warhead 30 incorporate dimpled portions 322A and 323A. More specifically, dimples 322A and 323A are concave depressions in side walls 322 and 323, respectively, that extend convexly into explosive material 14. After detonation of explosive material 14, each of dimples 322A and 323A collapses and forms an EFP that is expelled outward from warhead 30. While the shape of the dimples is not a limitation of the present invention, forming the dimples as portions of a sphere produces stable EFPs as is known in the art.

Figure 7:
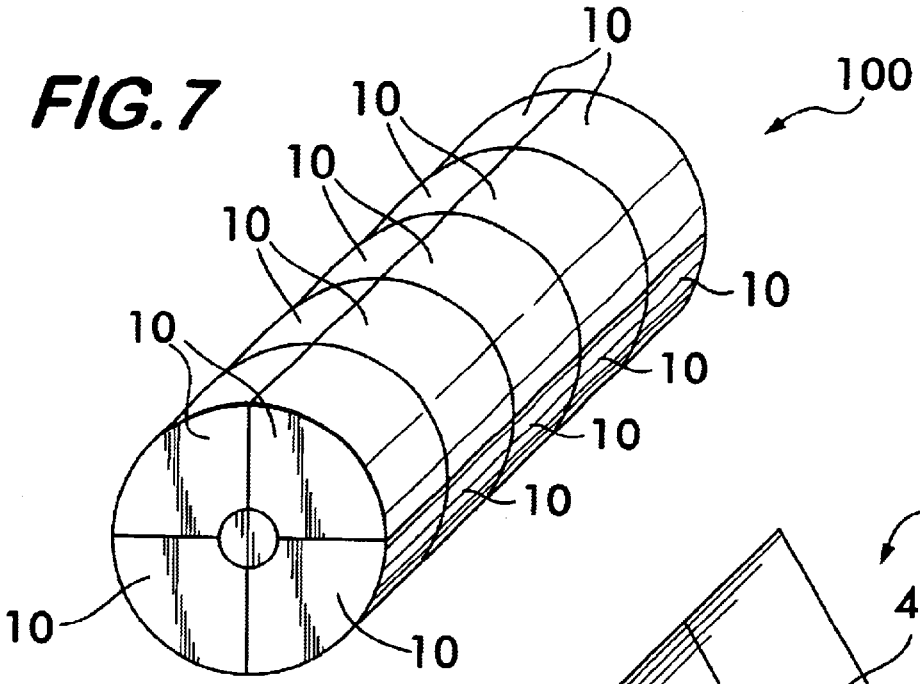
FIG. 7 is a perspective view of a cylindrical arrangement of multiple warheads constructed in accordance with the present invention.

The wedge-based shaped warhead described herein can make up one section of an ordnance package of a plurality of such warheads. For example, when the warheads are designed as portions of a cylindrical ring as is the case with warhead 10 or warhead 30, multiple ones thereof can be arranged to form a circular cylinder 100 as illustrated in FIG. 7. Note that cylinder 100 could also be constructed using some combination of warheads 10 and warheads 30. Thus, cylinder 100 comprises an adaptable, mission-responsive ordnance that can be dispersed/detonated in accordance with a predetermined plan or in accordance with a plan that is provided in real-time based on specific and changing mission requirements. Delivery of cylinder 100 and dispersement of warheads 10 can be accomplished as described in a co-pending U.S. patent application entitled "MISSION RESPONSIVE ORDNANCE" (Navy Case No. 79558), application Ser. No. 10/103,749, filed on Mar. 25, 2002, and owned by the same assignee as the present invention. The contents of this co-pending patent application is hereby incorporated by reference.

Figure 8:
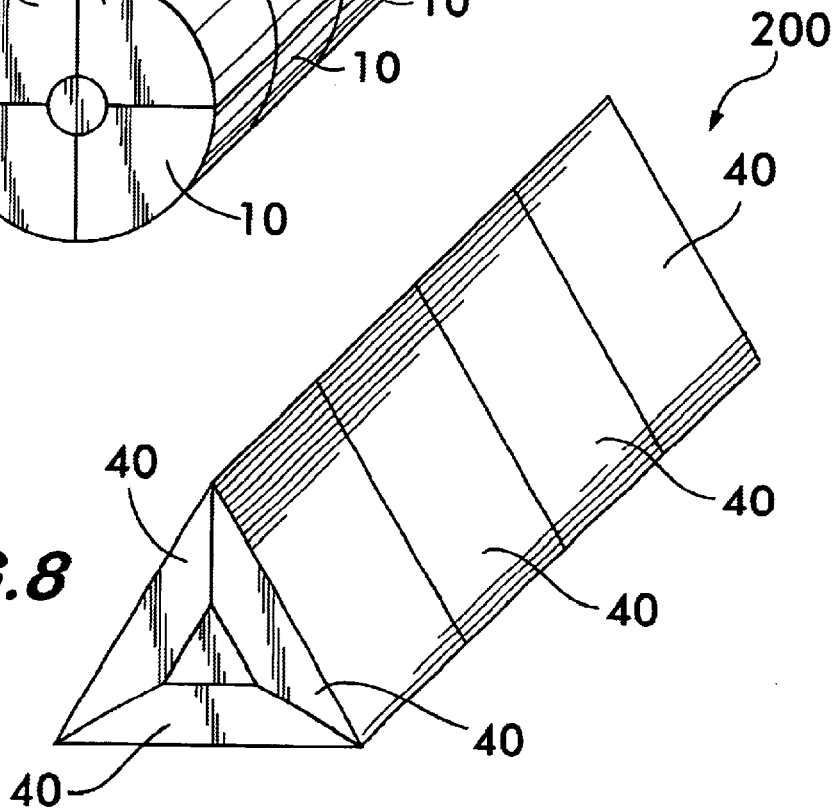
FIG. 8 is a perspective view of a triangular arrangement of multiple warheads constructed in accordance with the present invention.
Figure 9:
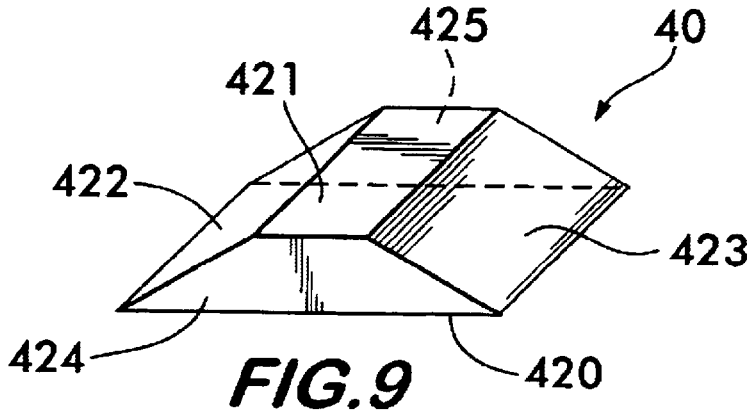
FIG. 9 is a perspective view of one of the warheads making up the triangular arrangement.

Although the present invention's wedge-based construction has been described relative to a portion of a cylindrical ring, is not so limited. Each wedge-based warhead could also be formed as a portion of a ring having a geometry other than that of a cylinder without departing from the scope of the present invention. For example, as illustrated in FIGS. 8 and 9, each warhead could be formed as a portion of a triangular ring. More specifically, each of warheads 40 has a casing 42 defining an outer radial wall 420, inner radial wall 421, side walls 422 and 423, and axial end walls 424 and 425. The individual warheads 40 can be arranged in a triangular stack 200. Other simple or complex geometries can be used without departing from the scope of the present invention.

The advantages of the present invention are numerous. A single warhead can produce both fragments and one or more EFPs. In this way, the same warhead can be used to defeat a variety of targets ranging from personnel to armored vehicles and structures. Speed and/or direction of both fragments and the EFPs can be controlled by in-flight adjustable features such as orientation of the warhead and selected detonation of initiators in the warhead. Thus, each warhead can be configured to be responsive to changing mission scenarios. Furthermore, the wedge-based geometry of each warhead allows multiple ones thereof to be packed in a logical stacked arrangement that can be delivered and dispersed at a target location by a mission responsive ordnance delivery vehicle.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A warhead comprising:

a casing defining a geometry that is a portion of a ring having an outer radial wall and an inner radial wall spaced radially apart from one another, said outer radial wall and said inner radial wall being joined radially by side walls, said casing being enclosed at either axial end thereof by end walls;

an explosive material filling said casing;

at least one initiator positioned in said explosive material along a radial plane of said ring that bisects said portion of said ring, wherein detonation of said at least one initiator detonates said explosive material;

said inner radial wall being constructed to form an explosively formed penetrator (EFP) after detonation of said explosive material; and said outer radial wall being constructed to form fragments after detonation of said explosive material.

2. A warhead as in claim 1 wherein said ring is a cylindrical ring.

3. A warhead as in claim 1 wherein said portion of said ring subtends an angle not to exceed 90°.

4. A warhead as in claim 1 wherein each of said side walls has at least one dimpled portion formed in an exterior surface thereof, said at least one dimpled portion extending convexly into said explosive material.

5. A warhead as in claim 4 wherein each said at least one dimpled portion is shaped as a portion of a sphere.

6. A warhead as in claim 1 wherein said at least one initiator comprises a single initiator positioned adjacent said outer radial wall.

7. A warhead as in claim 6 wherein said single initiator is located an equal distance from each of said end walls.

8. A warhead as in claim 1 wherein said at least one initiator comprises a plurality of initiators disposed along said radial plane with one of said plurality of initiators being positioned adjacent said outer radial wall.

9. A warhead as in claim 8 wherein said plurality of initiators lie along a line that is an equal distance from each of said end walls.

10. A warhead as in claim 1 wherein said outer radial wall comprises:

a gas check wall adjacent said explosive material; and a plurality of individual objects coupled to said gas check wall, wherein said explosive material is separated from said plurality of individual objects by said gas check wall, and wherein said gas check wall vaporizes after detonation of said explosive material.

11. A warhead as in claim 10 wherein each of said plurality of individual objects is a solid object.

12. A warhead as in claim 1 wherein said outer radial wall is scored with a predetermined fragmentation pattern, and wherein said outer radial wall fractures along said predetermined fragmentation pattern after detonation of said explosive material.

13. A warhead as in claim 1 wherein thickness of said inner radial wall is greatest along said radial plane and then decreases as a function of distance from said radial plane.

14. A warhead comprising:

a casing defining a geometry that is a portion of a cylindrical ring having an outer radial wall and an inner radial wall spaced radially apart from one another, said outer radial wall and said inner radial wall being joined radially by side walls, said casing being enclosed at either axial end thereof by end walls;

an explosive material filling said casing;

at least one initiator positioned in said explosive material along a radial plane of said cylindrical ring that bisects said portion of said cylindrical ring, wherein detonation of said at least one initiator detonates said explosive material to generate heat and pressure in said casing;

said inner radial wall having a thickness that is greatest along said radial plane and that decreases as a function of distance from said radial plane, wherein said inner radial wall forms an explosively formed penetrator (EFP) after detonation of said explosive material; and said outer radial wall being of fragmentable construction, wherein said outer radial wall forms fragments after detonation of said explosive material.

15. A warhead as in claim 14 wherein said portion of said cylindrical ring subtends an angle not to exceed 90°.

16. A warhead as in claim 14 wherein each of said side walls has at least one dimpled portion formed in an exterior surface thereof, said at least one dimpled portion extending convexly into said explosive material.

17. A warhead as in claim 16 wherein each said at least one dimpled portion is shaped as a portion of a sphere.

18. A warhead as in claim 14 wherein said at least one initiator comprises a single initiator positioned adjacent said outer radial wall.

19. A warhead as in claim 18 wherein said single initiator is located an equal distance from each of said end walls.

20. A warhead as in claim 14 wherein said at least one initiator comprises a plurality of initiators disposed along said radial plane with one of said plurality of initiators being positioned adjacent said outer radial wall.

21. A warhead as in claim 20 wherein said plurality of initiators lie along a line that is an equal distance from each of said end walls.

22. A warhead as in claim 14 wherein said outer radial wall comprises:

a gas check wall adjacent said explosive material; and a plurality of individual objects coupled to said gas check wall, wherein said explosive material is separated from said plurality of individual objects by said gas check wall, and wherein said gas check wall vaporizes after detonation of said explosive material.

23. A warhead as in claim 22 wherein each of said plurality of individual objects is a solid object.

24. A warhead as in claim 14 wherein said outer radial wall is scored with a predetermined fragmentation pattern, and wherein said outer radial wall fractures along said predetermined fragmentation pattern after detonation of said explosive material.

25. A warhead comprising:

a casing defining a geometry that is a portion of a cylindrical ring having an outer radial wall and an inner radial wall spaced radially apart from one another, said outer radial wall and said inner radial wall being joined radially by side walls, said casing being enclosed at either axial end thereof by end walls;

an explosive material filling said casing;

at least one initiator positioned in said explosive material along a radial line of said cylindrical ring that is centered between said side walls and centered between said end walls, wherein detonation of said at least one initiator detonates said explosive material;

said inner radial wall being constructed to form an explosively formed penetrator (EFP) after detonation of said explosive material; and said outer radial wall being of fragmentable construction, wherein said outer radial wall forms fragments after detonation of said explosive material.

26. A warhead as in claim 25 wherein said portion of said cylindrical ring subtends an angle not to exceed 90°.

27. A warhead as in claim 25 wherein each of said side walls has at least one dimpled portion formed in an exterior surface thereof, said at least one dimpled portion extending convexly into said explosive material.

28. A warhead as in claim 27 wherein each said at least one dimpled portion is shaped as a portion of a sphere.

29. A warhead as in claim 25 wherein said at least one initiator comprises a single initiator positioned adjacent said outer radial wall.

30. A warhead as in claim 25 wherein said at least one initiator comprises a plurality of initiators disposed along said radial line with one of said plurality of initiators being positioned adjacent said outer radial wall.

31. A warhead as in claim 25 wherein said outer radial wall comprises:

a gas check wall adjacent said explosive material; and a plurality of individual objects coupled to said gas check wall, wherein said explosive material is separated from said plurality of individual objects by said gas check wall, and wherein said gas check wall vaporizes after detonation of said explosive material.

32. A warhead as in claim 31 wherein each of said plurality of individual objects is a solid object.

33. A warhead as in claim 25 wherein said outer radial wall is scored with a predetermined fragmentation pattern, and wherein said outer radial wall fractures along said predetermined fragmentation pattern after detonation of said explosive material.

* * * * *